US006467547B2

(12) United States Patent
Maguire et al.

(10) Patent No.: US 6,467,547 B2
(45) Date of Patent: Oct. 22, 2002

(54) HYDRAULIC RUNNING TOOL WITH TORQUE DAMPENER

(75) Inventors: Patrick G. Maguire, Cypress, TX (US); Richard Duff, Sherwood Park (CA); Tarald Gudmestad, Houston; Mark Murray, Sugar Land, both of TX (US)

(73) Assignee: Weatherford/Lamb, Inc., Houston, TX (US)

( * ) Notice: Subject to any disclaimer, the term of this patent is extended or adjusted under 35 U.S.C. 154(b) by 51 days.

(21) Appl. No.: 09/734,489

(22) Filed: Dec. 11, 2000

(65) Prior Publication Data

US 2002/0070032 A1 Jun. 13, 2002

(51) Int. Cl.[7] ..... E21B 34/10; E21B 17/02
(52) U.S. Cl. ..... 166/386; 166/242.6
(58) Field of Search ..... 166/212, 373, 166/377, 381, 382, 383, 386, 242.6, 208

(56) References Cited

U.S. PATENT DOCUMENTS

| | | | | | |
|---|---|---|---|---|---|
| 2,712,920 | A | * | 7/1955 | Cullen et al. | 166/212 |
| 3,995,479 | A | * | 12/1976 | Chapman, III | 73/152.47 |
| 4,526,241 | A | * | 7/1985 | Anders | 175/321 |
| 4,598,774 | A | * | 7/1986 | Nevels et al. | 166/124 |
| 4,834,185 | A | * | 5/1989 | Braddick | 166/208 |
| 4,848,469 | A | * | 7/1989 | Baugh et al. | 166/123 |
| 4,909,321 | A | * | 3/1990 | Petree | 166/237 |
| 4,997,041 | A | * | 3/1991 | Petree | 166/377 |
| 5,000,266 | A | * | 3/1991 | Saunders et al. | 166/136 |
| 5,082,060 | A | * | 1/1992 | Johnson et al. | 166/208 |
| 5,086,843 | A | * | 2/1992 | Mims et al. | 166/208 |
| 5,086,845 | A | * | 2/1992 | Baugh | 166/206 |
| 5,472,055 | A | * | 12/1995 | Simson et al. | 166/208 |
| 5,535,823 | A | * | 7/1996 | Reid | 166/123 |
| 5,551,512 | A | * | 9/1996 | Smith | 166/212 |
| 5,697,449 | A | * | 12/1997 | Hennig et al. | 166/124 |
| 5,794,694 | A | * | 8/1998 | Smith, Jr. | 166/212 |
| 6,041,859 | A | * | 3/2000 | Blades | 166/208 |
| 6,053,244 | A | | 4/2000 | Dybevik et al. | 166/208 |
| 6,308,940 | B1 | * | 10/2001 | Anderson | 175/300 |

FOREIGN PATENT DOCUMENTS

| | | | | |
|---|---|---|---|---|
| WO | WO 97/25515 A1 | * | 7/1997 | E21B/17/06 |

* cited by examiner

*Primary Examiner*—David Bagnell
*Assistant Examiner*—Jennifer H Gay
(74) *Attorney, Agent, or Firm*—Moser, Patterson & Sheridan, L.L.P.

(57) ABSTRACT

The present invention generally provides a running tool comprising a torque-dampening system. A first portion and a second portion of the running tool are operably related by a torsion interface. In one embodiment, the torsion interface includes a plurality of interlaced teeth disposed on the each of the first and second portions. During relative rotation of the first and second portions, the teeth engage and "ride up" on one another, thereby forcing the first and second portions in opposite axial directions. At least one of the portions houses a flow restrictor assembly adapted to restrict fluid flow from one region to another during the axial movement of the portions. Accordingly, the relative rotation between the portions is inhibited, or dampened.

53 Claims, 11 Drawing Sheets

HYDRAULIC RUNNING TOOL WITH TORQUE DAMPENER

BACKGROUND OF THE INVENTION

1. Field of the Invention

The present invention relates generally to running tools. More specifically, the invention relates to a running tool adapted to compensate for undesired torque in order to prevent premature release of a component secured to the running tool.

2. Background of the Invention

Running tools are used for various purposes during well drilling and completion operations. For example, a running tool is typically used to set a liner hanger in a well bore. The running tool is made up in the drill pipe or tubing string between the liner hanger and the drill pipe or tubing string running to the surface. In one aspect, the running tool serves as a link to transmit torque to the liner hanger to help place and secure the liner in the well bore. In addition, the tool also provides a conduit for fluids such as hydraulic fluids, cement and the like. Upon positioning of the liner hanger at a desired location in the well bore, the running tool is manipulated from the surface to effect release of the liner hanger from the running tool. The liner may then optionally be cemented into place in the well bore. In some cases, the cement is provided to the well bore before releasing the liner.

The application of torque to the drill string facilitates lowering the liner past obstructions formed in the well bore. For example, during drilling the drill bit often creates pockets in the surfaces of the well bore. While being lowered, the liner may move into the pockets. By rotating the liner, the liner is able to navigate through the pockets more easily.

In a typical drill pipe or tubing string, lengths of drill pipe or tubing are connected by tool joints using right-hand threads on the drill pipe. These joints are made up using right-hand torque and unscrewed or released using left-hand torque. Drilling is carried out by right-hand or clockwise rotation of the drill string to avoid breaking out or loosening the tool joints making up the pipe string. In the case of a mechanical release, left-hand torque is then applied o the drill string. In particular, the torque is sufficient to shear one or more shear screws located in the running tool. Subsequently, the liner may be detached from the running tool.

A problem occurs when the liner (or potentially even the running tool or drill string) engages an obstruction (e.g., a rock formation) that prevents continued clockwise rotation of the liner. As the surface actuator continues to provide torque to the drill string, the drill string is "wound up," much like a rubber band or other elongated elastic member. Once the liner breaks free of the obstruction, the accumulated potential energy due to the winding up is converted into kinetic energy as the drill string unwinds by rotating in the clockwise direction. In some cases (where enough energy is available), the liner may over-travel the neutral drilling position. This has the effect of simulating a manual mechanical release because the running tool is now turning in a left-hand (counter-clockwise) direction relative to the liner. In the event the shear screws shear out, the running tool is prematurely released from the liner hanger.

Another problem with prior art methods and apparatus is balancing the need for sufficient strength of the shearing screws while still allowing them to shear out when necessary. Consider, for example, the case in which the liner hanger may be of relatively light weight. When the hanger is set and ready to be mechanically released, the applied left-hand torque may cause the hanger to rotate in tandem with the drill string, thereby inhibiting the release procedure.

Therefore, there exists a need for a running tool that compensates for over-travel of the tool to prevent prematurely releasing the tool from a liner hanger or other connected component.

SUMMARY OF THE INVENTION

The present invention is directed to a running tool for setting a liner or other tool down hole. The running tool generally comprises a torque-dampening system.

In one aspect, the invention provides a running tool for a well tool, comprising a first portion, a second portion and a torsion interface disposed therebetween. A torque-dampening system contacts the first portion and is adapted to inhibit the relative rotational movement between the first and second portions during an opposing linear displacement.

In another aspect, the invention a running tool comprising a torsion interface adapted to cause opposing linear displacement of a first and second portions upon their relative rotation. A tubular member is concentrically disposed within the first and second portions and the tubular member is slidably disposed relative to the first portion. A torque-dampening system is located between the tubular member and the first portion. When actuated in response to the opposing linear displacement of the first and second portions, the torque-dampening system inhibits the relative rotational movement between the first and second portions.

In another aspect, a mechanical release is provided to enable operation of a running tool without the assistance of hydraulic pressure and without conventional shearing screws, which are made to shear out during application of left-hand torque to the tool. The mechanical release assembly comprises a first sleeve and a second sleeve each carrying a plurality of intermeshed teeth (which do not necessarily contact one another). During application of left-hand torque, the teeth engage and ride up one another to linearly displace the first sleeve and a second sleeve. As a result, the first sleeve strokes up relative to a tubular member concentrically slidably disposed within the first sleeve. In response to the linear displacement of the sleeves, a torque-dampening system, located between a tubular member and the first sleeve, is actuated to inhibit the relative rotational movement between the sleeves. Upon a predetermined degree of rotation, the teeth disengage, rotate over one another and come to rest in a release position. Downward pressure is then applied to the tubular member, thereby shifting the tubular member down relative to the sleeves and causing the tool to disengage from a liner hanger coupled to a bottom portion of the tool.

In another aspect, a method for dampening rotation of a sleeve on a running tool is provided. The method comprises providing a first and second portion of a running tool, wherein a portion of the first portion is adapted to interface with a down hole tool. The rotation of the first portion is then restricted by actuating a fluid-actuated torque-dampening system operably connected to the first portion. In one embodiment, the first portion is operably connected to a second portion. The movement of the first portion is then restricted such that movement of the second portion is also restricted.

BRIEF DESCRIPTION OF THE DRAWINGS

A more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF A PREFERRED EMBODIMENT

Figure 1A:
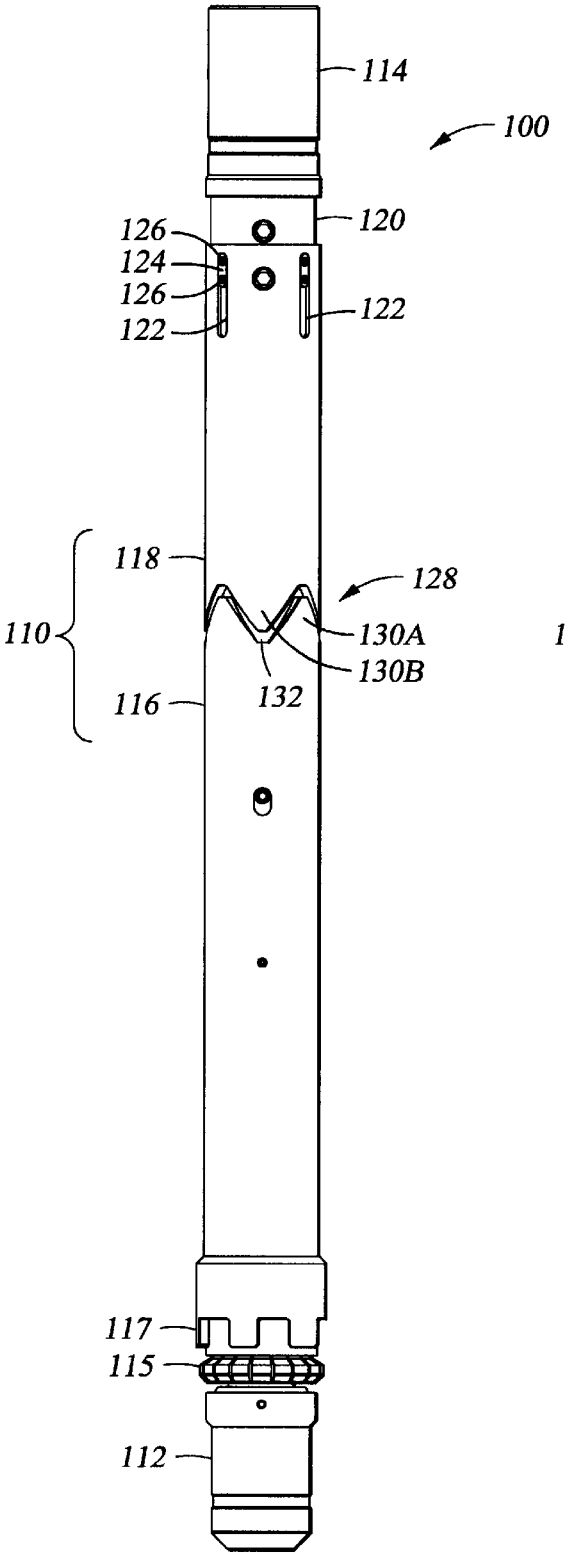
FIGS. 1A–C is an elevation view of a running tool.
Figure 1B:
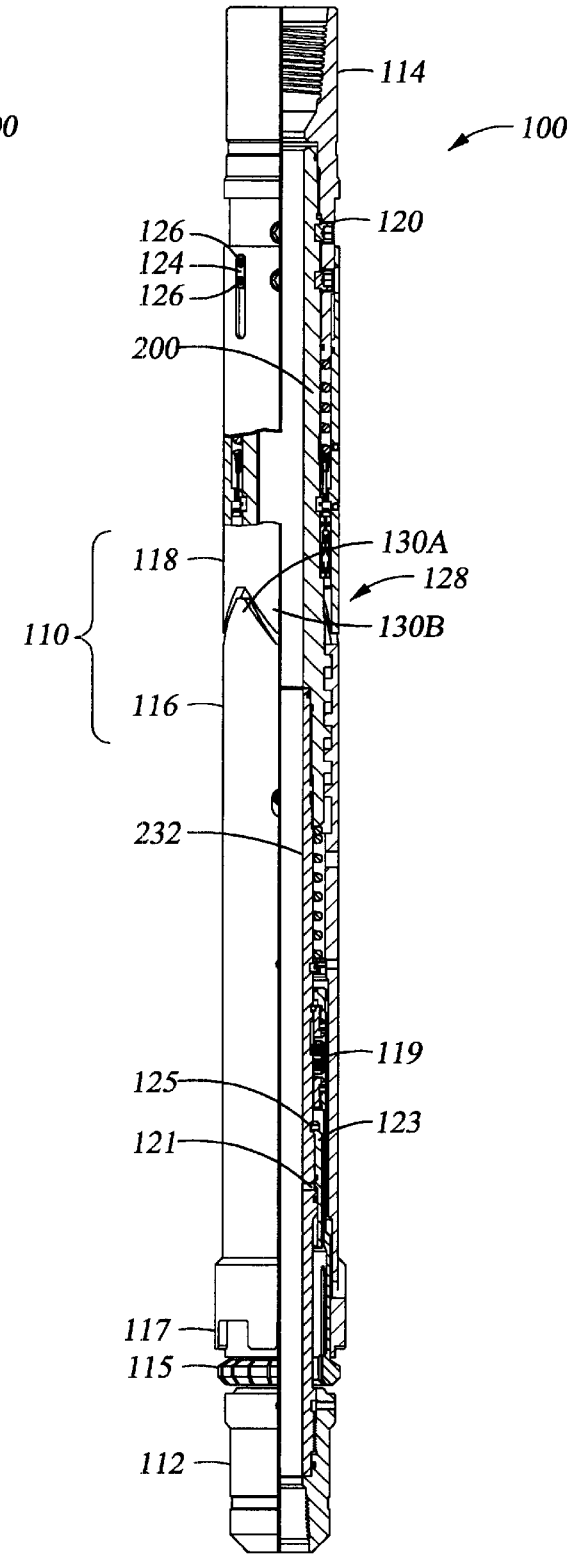
Figure 1C:
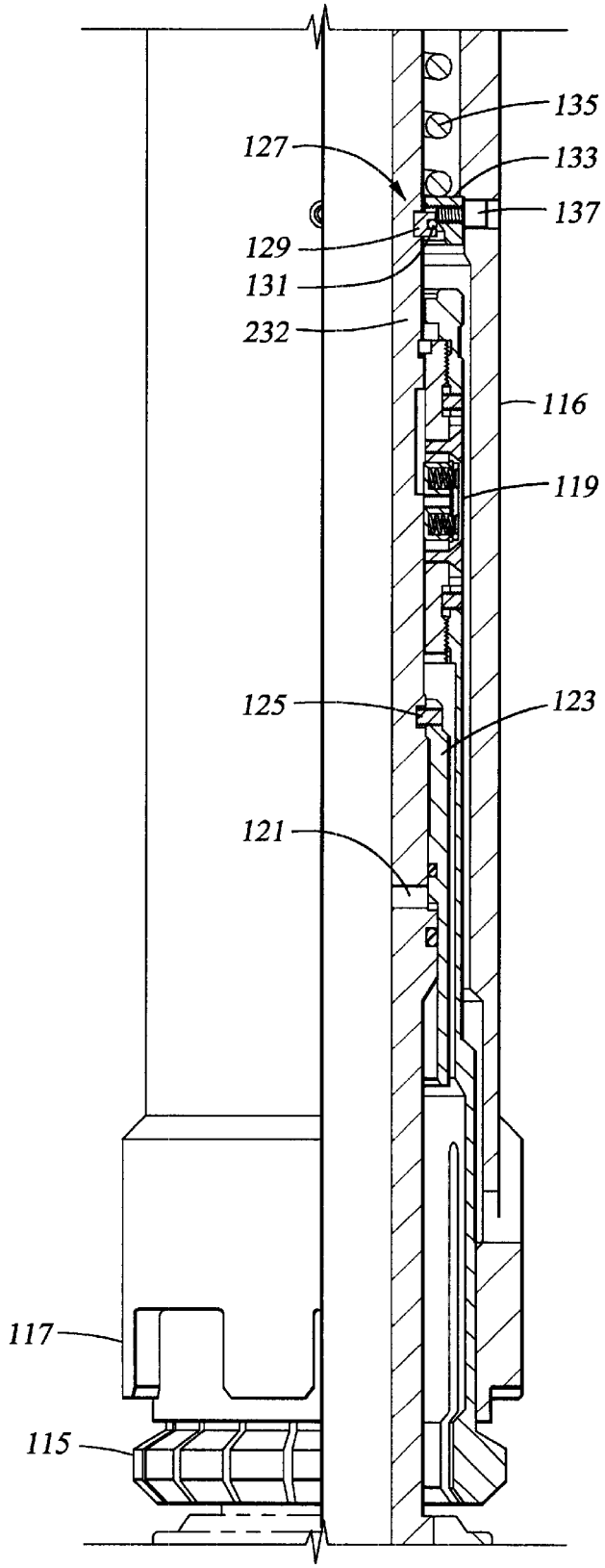

FIGS. 1A–C is an elevation view of a running tool 100 according to one aspect of the invention. The running tool 100 is shown in an assembly position in which position the running tool 100 is ready to receive a liner hanger running profile. Once the setting sleeve or liner hanger is connected, the tool 100 is said to be in a running-in position. The running tool 100 can then be made up on a pipe string for releasably engaging the liner hanger in a well bore.

The running tool 100 generally includes a cylinder body 110, a bottom connector 112 disposed at a lower end and an internally threaded top connector 114. The bottom connector 112 supports a collet assembly 115, which is connectable to a liner hanger (not shown), and the top connector 114 is connectable to a pipe string (also not shown). The lower portion of the running tool 100 (best seen in FIG. 1C) also includes components such as a castellation portion 117 for engaging and carrying a liner hanger and a dogs assembly 119 actuated to disengage from a liner hanger. These and other components are well known in the art and a detailed description is not necessary.

The cylinder body 110 includes a torque sleeve 116 and a clutch sleeve 118. Both the torque sleeve 116 and the clutch sleeve 118 are concentrically disposed about a tubular member. Illustratively, the tubular member is formed from a bayonet 200 and a mandrel 232 which define a bore 208. The torque sleeve 116 is rotatably disposed about the bayonet 200 and the mandrel 232 and secured from relative axial movement in one direction (e.g., downward toward the collet assembly 115) by a retaining assembly 127 disposed on the mandrel 232. Illustratively, the retaining assembly 127 comprises a split ring 129 secured by a snap ring 131. The retaining assembly 127 acts as a support for a spring stop 133 that is rigidly secured to the torque sleeve 116 by a fastener 137, such as a bolt. The spring stop 133 rotates freely over the retaining assembly 127 and because the torque sleeve 116 is not otherwise rigidly fixed, the torque sleeve 116 is permitted to rotate relative to the mandrel 232. The spring stop 133 also provides a lower constraint for a spring 135, which is constrained at an upper end by the bayonet 200. The spring acts to bias the spring stop 133 toward the retaining assembly 127. Thus, the spring stop 133 and the retaining assembly 127 often in mating abutment during operation of the tool 100.

The upper end of the clutch sleeve 118 is concentrically slidably disposed over a lower portion 120 of the top connector 114. Controlled axial (i.e. liner) movement of the clutch sleeve 118 relative to the top connector 114 is facilitated by the provision of a slot 122 and a key 124. The slot 122 is an elongated opening formed at one end of the clutch sleeve 118 and having its length oriented along the axis of the running tool 100. The key 124 is disposed within the slot 122 and is allowed to move freely through the length of the slot 122. The key 124 is secured to the top connector 114 by screws 126, thereby preventing relative rotational movement between the top connector 114 and clutch sleeve 118.

The torque sleeve 116 and clutch sleeve 118 are operably related by a torsion interface 128 that allows a relative torque between the torque sleeve 116 and clutch sleeve 118 to produce relative axial movement between the torque sleeve 116 and clutch sleeve 118. In a particular embodiment shown in FIG. 1, the torsion interface 128 comprises a plurality of intermeshed teeth 130A and 130B, or cogs, disposed on respective ends of the torque sleeve 116 and clutch sleeve 118. In the presence of a relative torque between the torque sleeve 116 and clutch sleeve 118, the teeth 130 engage with one another to provide axial thrust, thereby driving the clutch sleeve 118. Although in the embodiment shown in FIG. 1 the clutch sleeve 118 is axially driven, in other embodiments the torque sleeve 116 may be the axially driven member.

In the assembly position, the teeth 130A–B are separated by a gap 132. The gap 132 allows clearance for the torque sleeve 116 to ride up a mandrel 232 (shown, for example, in FIG. 8 and described below) when the liner hanger is being coupled to the running tool 100. Once the liner hanger is attached to the tool 100 (i.e., the tool 100 is in the running-in position), the gap 132 is substantially narrower and, in one embodiment, eliminated.

Figure 2:
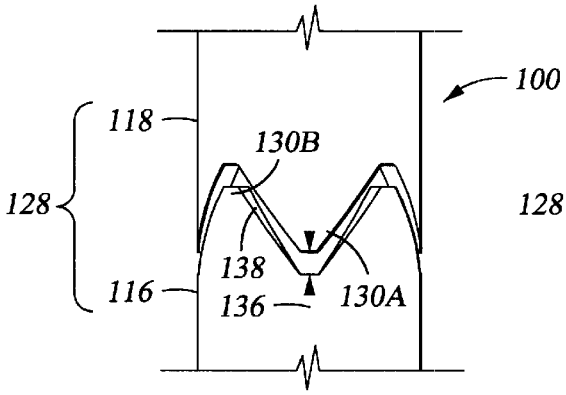
FIGS. 2–7 are partial side views a running tool illustrating operation of a torsion interface during application of torque.

The operation of the torsion interface 128 is described with reference to FIG. 2 through FIG. 7. In FIG. 2, the running tool 100 is shown in an initial running-in position. This position is maintained during normal drilling operation of the running tool 100, i.e. during application of right hand torque causing synchronous rotation of the torque sleeve 116 and clutch sleeve 118. In such a position, the hydraulic cylinder teeth 130A and the torque sleeve teeth 130B are separated from one another by a gap 136. In a particular embodiment, the gap 136 is merely provided to accommodate a desired degree of axial tolerance (e.g., 0.5 inches) necessary to disengage the tool 100 from a liner hanger. During operation, the gap 136 may be periodically closed when the torque sleeve 116 and clutch sleeve 118 collapse toward one another (e.g., due to a force acting on each end of the tool 100).

Figure 3:
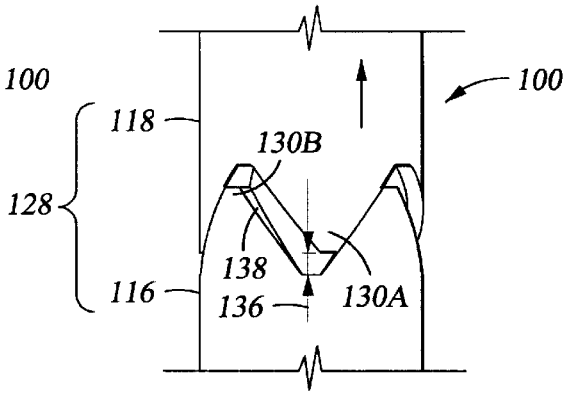
Figure 4:
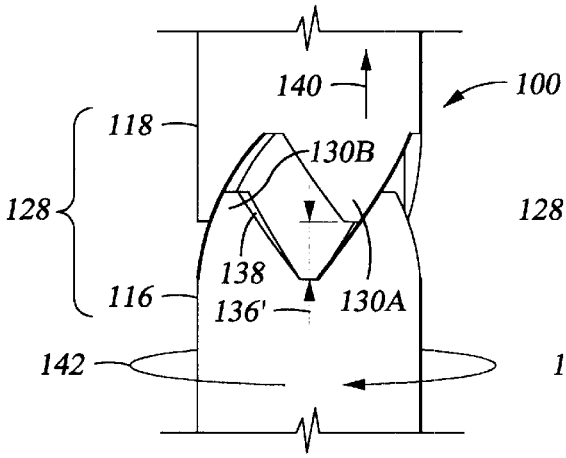

FIG. 3 shows the effect of applying a right-hand torque to the torque sleeve 116 while the clutch sleeve 118 is held stationary. This is equivalent to a left-hand torque applied to the clutch sleeve 118 while the torque sleeve 116 is held stationary. In either case, the clutch sleeve 118 and the torque sleeve 116 rotate relative to one another causing the teeth 130 to engage. The teeth 130 define inclined surfaces 138, or flanks, which, when rotated against one another, produce an opposing force. As a result, the clutch sleeve 118 is axially actuated away from the torque sleeve 116 as shown by arrow 140. As shown in FIGS. 3 and 4, during continued application of left-hand torque, the gap 136' between the torque sleeve 116 and the clutch sleeve 118 is widened as the respective inclined surfaces 138 continue to slide over one another.

Figure 5:
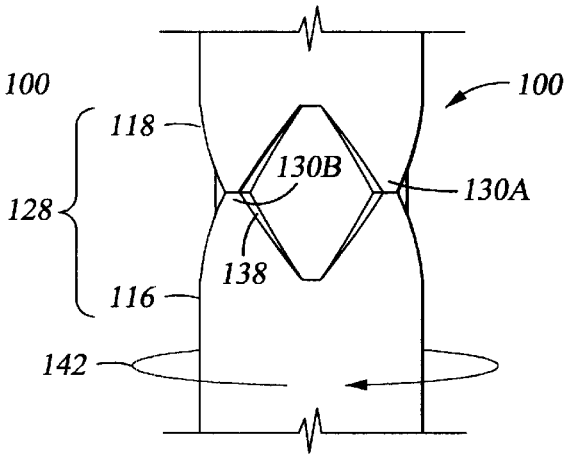
Figure 6:
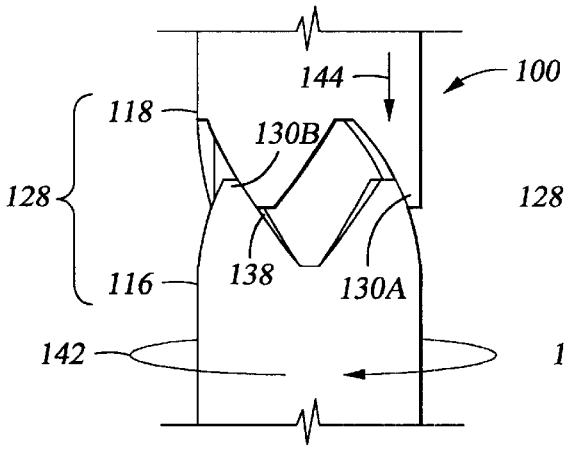
Figure 7:
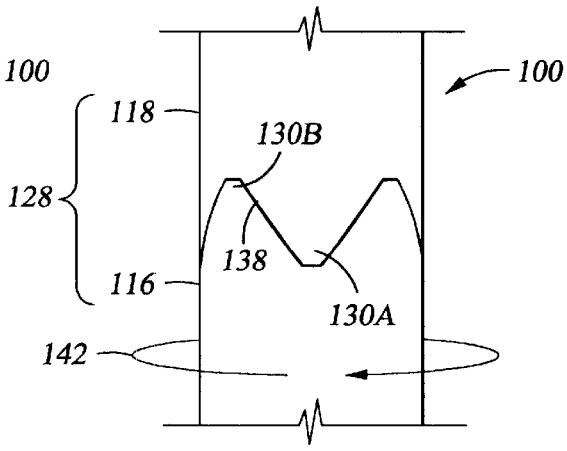

If the torque ceases prior to the teeth 130 disengaging and rotating past one another, then the torque sleeve 116 and the clutch sleeve 118 return to the neutral drilling position (shown in FIG. 2). If, however, the torque continues, then the teeth 130 rotate past one another as shown in FIG. 5 and FIG. 6. Further, as shown in FIG. 6, the torque sleeve 116 and the clutch sleeve 118 begin to collapse toward one another due to the relative axial movement of the clutch sleeve 118 in the direction indicated by arrow 144. FIG. 7 shows the running tool 100 in a terminal position, or release position, after the torque sleeve 116 and the clutch sleeve 118 have been rotated one tooth 130 over and are fully collapsed (i.e., the gap 136 is closed). In the terminal position, the liner (not shown) is released from the running tool 100 and the running tool 100 may then be extracted from the well bore.

In a particular application, the torque referenced above may be caused by the over-rotation of the torque sleeve 116 relative to the clutch sleeve 1118. Such over-rotation may occur after the torque sleeve 116 is freed from an impediment to rotation (e.g., a sloughed in formation). The potential energy stored in the drill string above the running tool 100 and in the liner below the tool 100 while the tool 100 was inhibited from rotation is released as rotational kinetic energy once the tool is freed from the obstruction to rotation. If enough energy is available, the torque sleeve 116 may continue rotating (in the direction shown by arrow 142) beyond the neutral drilling position causing the teeth 130 to engage. In another application, the relative rotation between the torque sleeve 116 and the clutch sleeve 118 is the result of a purposeful mechanical release facilitated by the surface application of a left-hand torque to the running tool while the torque sleeve 116 is held stationary (e.g., by a liner resting in the wellbore).

The foregoing embodiments of the torsion interface 128 are merely illustrative. In general, the torsion interface 128 is any assembly, device, or structural formation that allows a relative torque between the torque sleeve 116 and clutch sleeve 118 to produce relative axial movement between the torque sleeve 116 and clutch sleeve 118 Thus, in another embodiment, the torsion interface 128 comprises threads formed on a lower inner surface of the clutch sleeve 118. Mating counter-threads formed on the upper outer surface of the torque sleeve 116 may be fitted in to the threads of the clutch sleeve 118. Upon relative rotation of the sleeves 116, 118 the clutch sleeve is stroked upward. Unthreaded surfaces between the threaded portion of each sleeve allow the threads to disengage and sleeves to collapse inward toward one another. Persons skilled in art will recognize other embodiments.

It is understood that the terms "right-hand torque" and "left-hand torque" are relative terms and that the invention is not limited by the use of such terms. Accordingly, in other embodiments, the drilling torque may be left-hand torque and the applied torque to mechanically release running tool 100 from a liner, or other component being carried by the tool, may be right-hand torque.

During the relative rotation of the sleeves 116, 118 shown in FIGS. 3–4, the clutch sleeve 118 experiences a torque dampening effect that resists the relative rotation. Accordingly, the relative linear movement of the clutch sleeve 118 and the torque sleeve 116 away from each other is restrained or resisted. Such a torque dampening effect is caused by the provision of a torque dampening system housed within the running tool 100. The torque dampening system and other features of the tool 100 will now be described with reference to FIGS. 8–13.

Figure 8A:
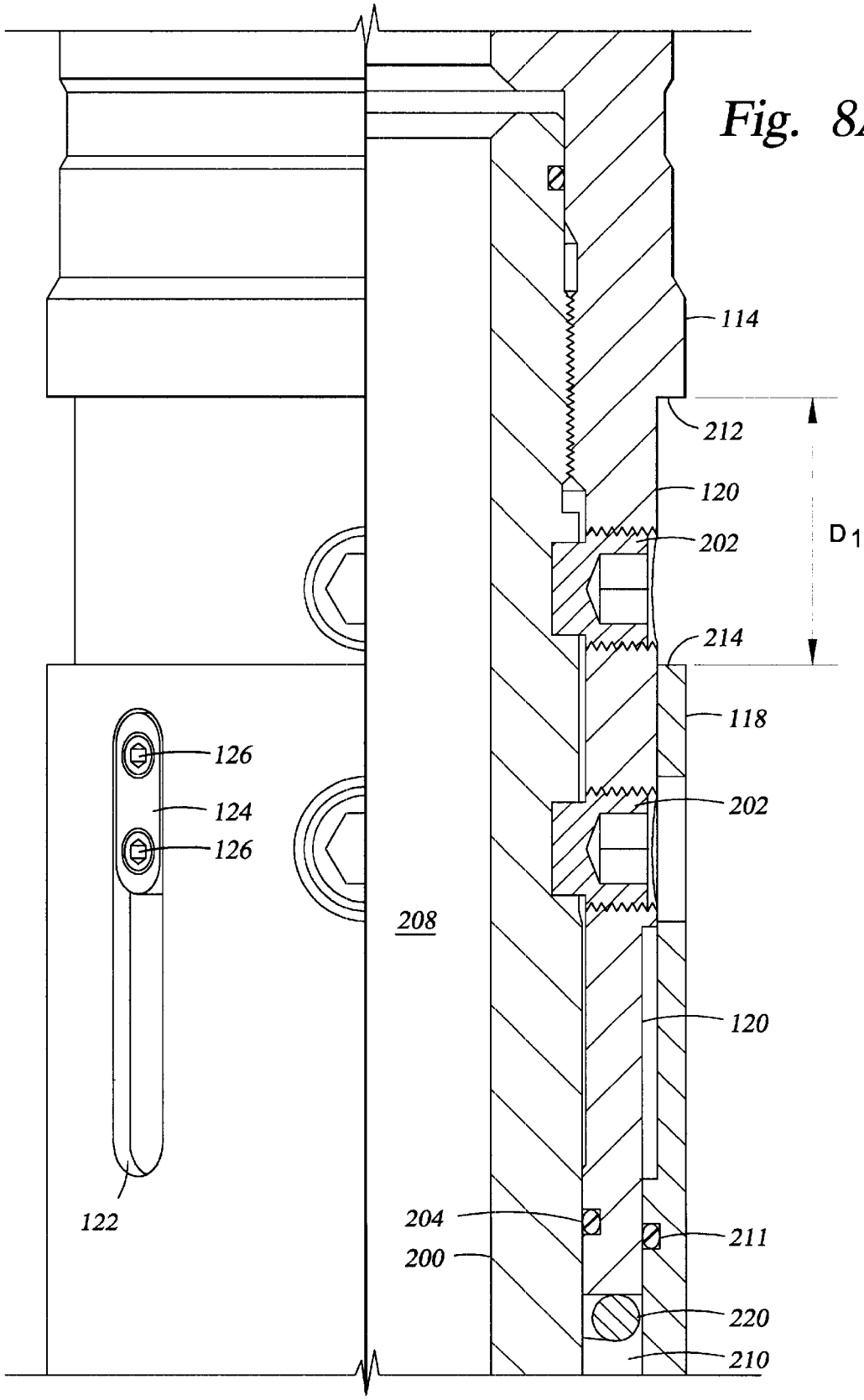
FIGS. 8A–C are side views partially in section of a running tool in a running-in position.
Figure 8B:
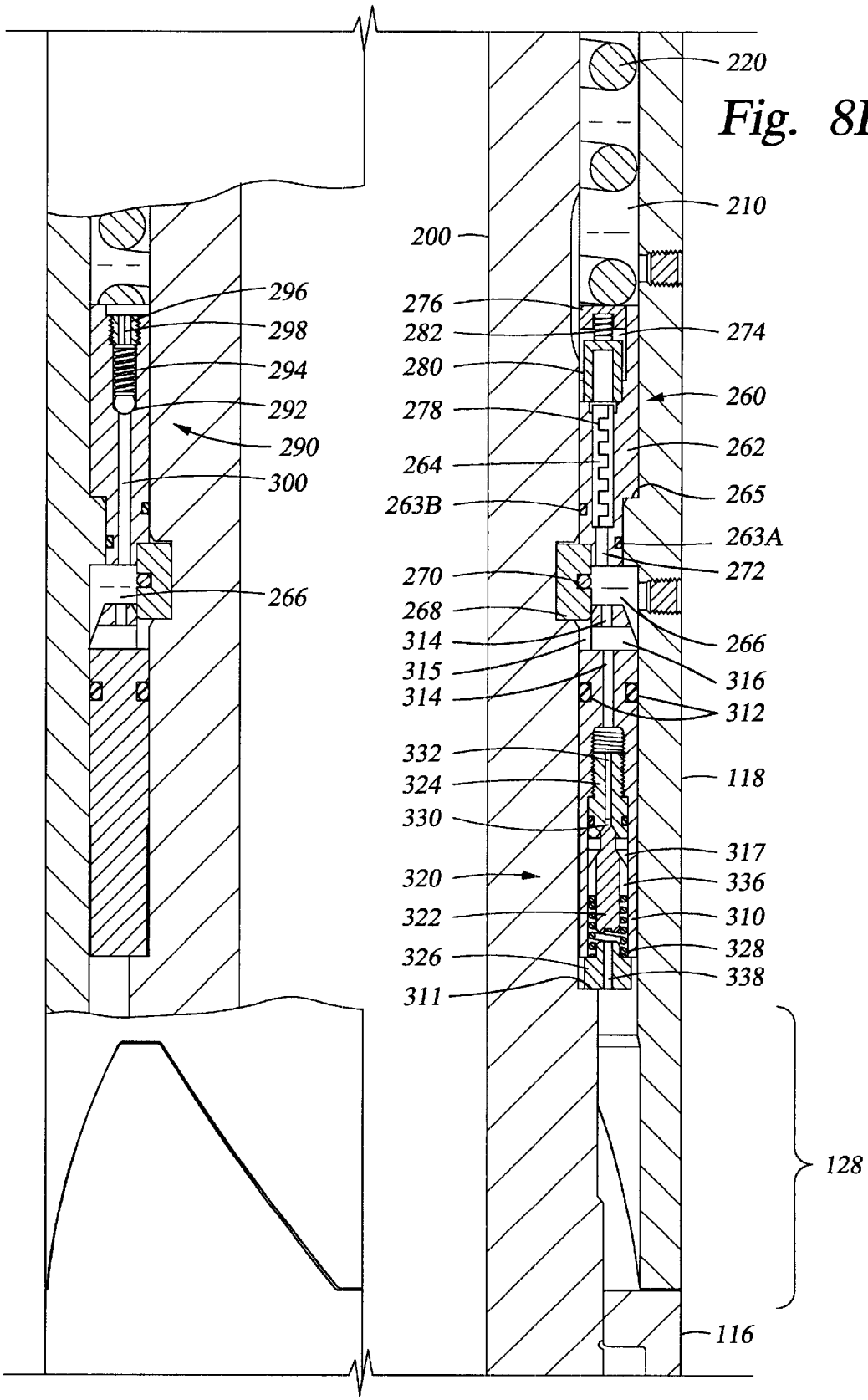
Figure 8C:
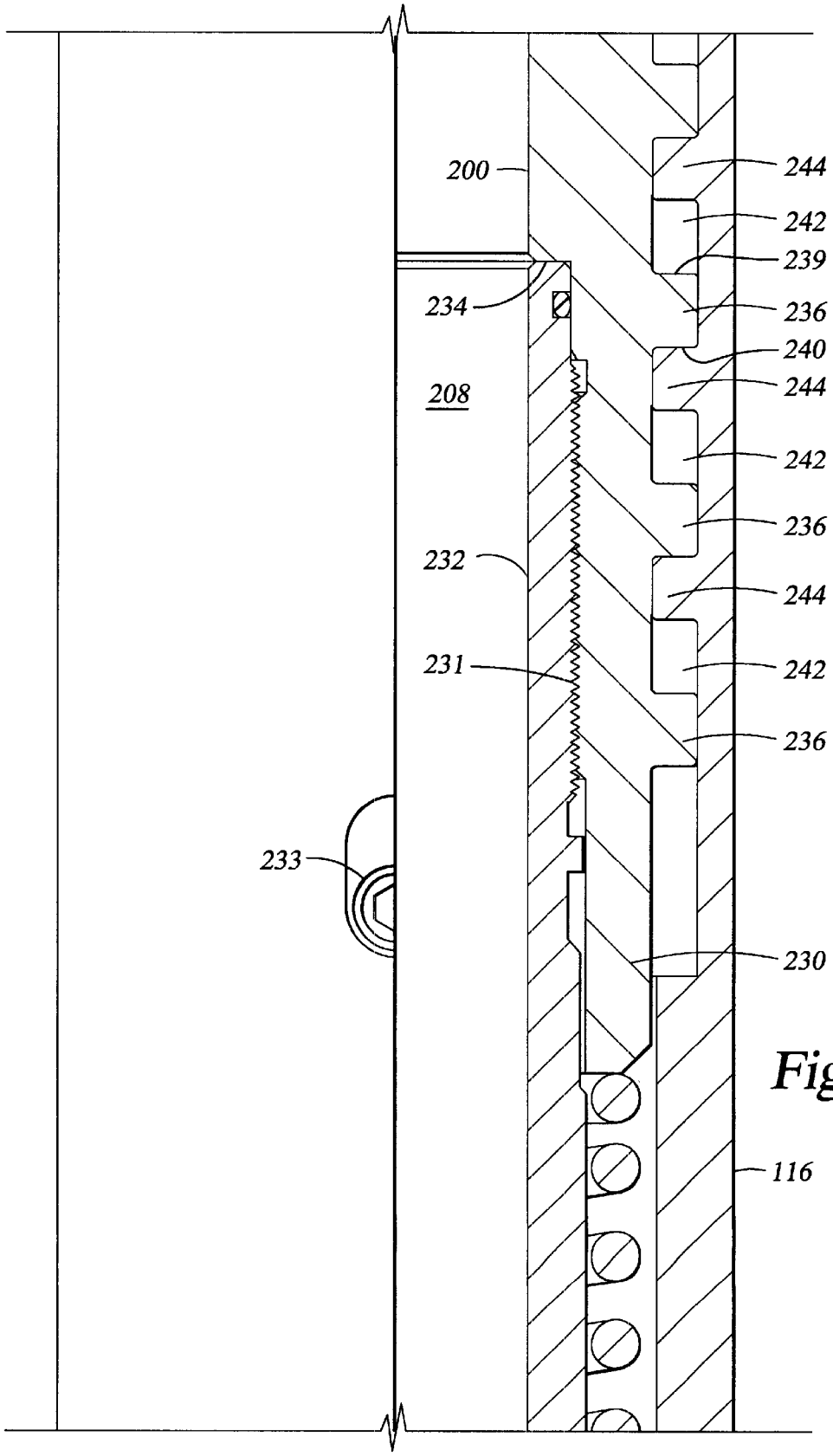

FIGS. 8A–C shows a partial cutaway of an upper portion of the running tool 100 in a running-in position. FIGS. 8A–C shows a bayonet 200 axially disposed along the length of the running tool 100. The bayonet 200 is a generally tubular member defining a central bore 208 through which a fluid (e.g., hydraulic fluid) may be flowed. The bayonet 200 is secured at its upper end to the lower portion 120 of the top connector 114 by fasteners, such as torque screws 202. Accordingly, the bayonet 200 and the top connector 114 are constrained against any relative axial or rotational movement. Further, an 0-ring seal 204 is disposed between the inner diameter of the lower portion 120 and outer diameter of the bayonet 200 in order to prevent fluid flow from a chamber 210.

As shown in FIG. 8C, a tip 230 of the bayonet 200 is located at an upper end of the torque sleeve 116. The tip 230 provides a diametrically enlarged opening to receive a portion of a mandrel 232. The bayonet 200 and the mandrel 232 are secured to one another by a threaded interface 231 and a set screw 233. Together, the bayonet 200 and the mandrel 232 form a tubular member having the bore 208 axially disposed therein. Although described herein as two separate members, the bayonet 200 and the mandrel 232 may be integrally formed of a single piece of material or formed as two materials and permanently fixed together, e.g., by welding.

The mandrel 232 abuts a ledge 234 formed on an inner surface of the bayonet 200, thereby preventing the mandrel 232 from sliding freely beyond a predetermined position relative to the bayonet 200. In addition, the ledge 234 ensures that the axial movement of the bayonet 200 toward the bottom connector 112 is transferred through the mandrel 232. This relationship is needed during the mechanical release of the liner hanger (not shown) from the running tool 100 during which a downward force is applied to the bayonet 200.

The bayonet 200 also carries a plurality of ribs 236 on an outer surface which are adapted to limit the relative movement between the bayonet 200 and the torque sleeve 116 within a predetermined allowance. The ribs 236 and additional features of the bayonet 200 will be described with brief reference to FIG. 9 and FIG. 10.

Figure 9:
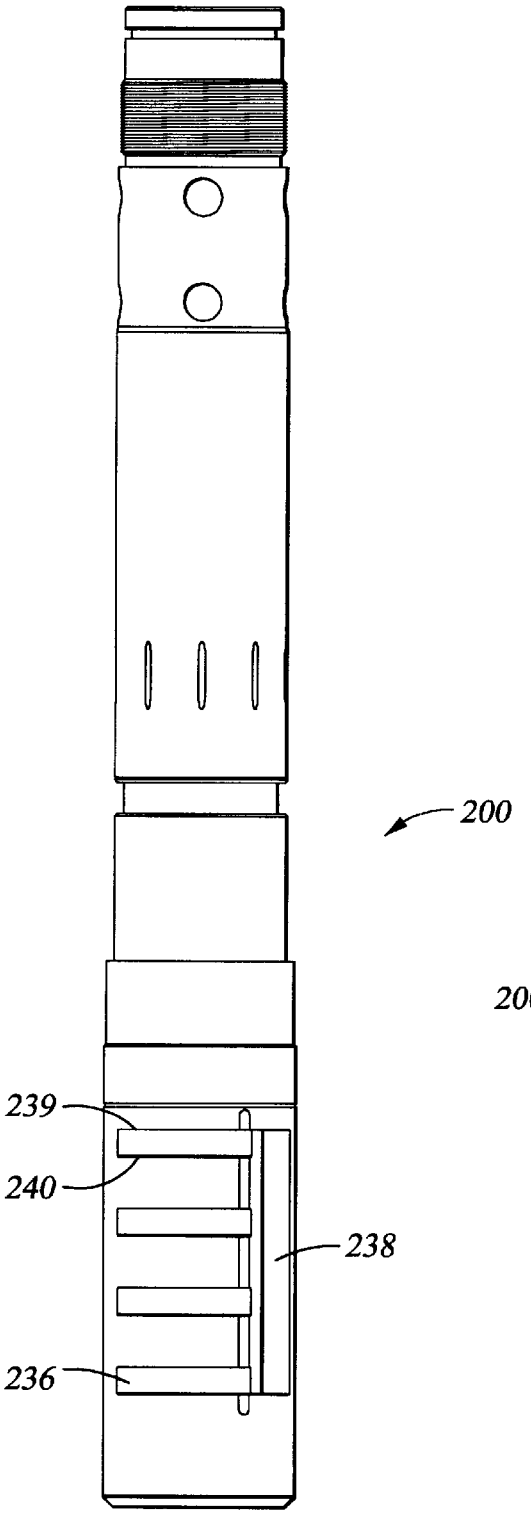
FIG. 9 is an elevation view of a bayonet.
Figure 10:
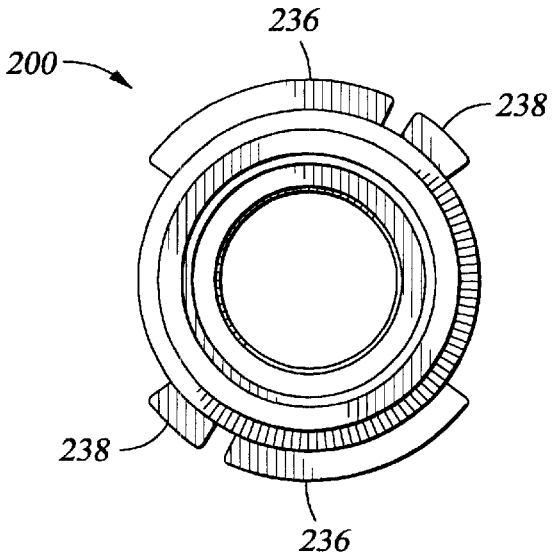
FIG. 10 is a top cross-sectional view of the bayonet shown in FIG. 9.

FIG. 9 and FIG. 10 show an elevation review and a bottom view, respectively, of the bayonet 200. The ribs 236 are annular sections circumferentially disposed on the bayonet. Each rib 236 defines an upper surface 239 and a lower surface 240 adapted to engage corresponding surfaces on the torque sleeve 116, as will be discussed below with reference to FIG. 8. In the particular embodiment shown, the ribs 236 comprise two sets of four on opposite sides of the bayonet 200. Although eight (8) ribs 236 are shown, any number may be used.

Adjacent to each set of ribs 236 is a spline or stop member 238. The stop member 238 is an elongated protrusion extending axially along the length of the bayonet 200. The stop members 238 are adapted to limit the degree of rotation allowed by the bayonet 200 while seated in the torque sleeve 116, as will be discussed below.

Figure 11:
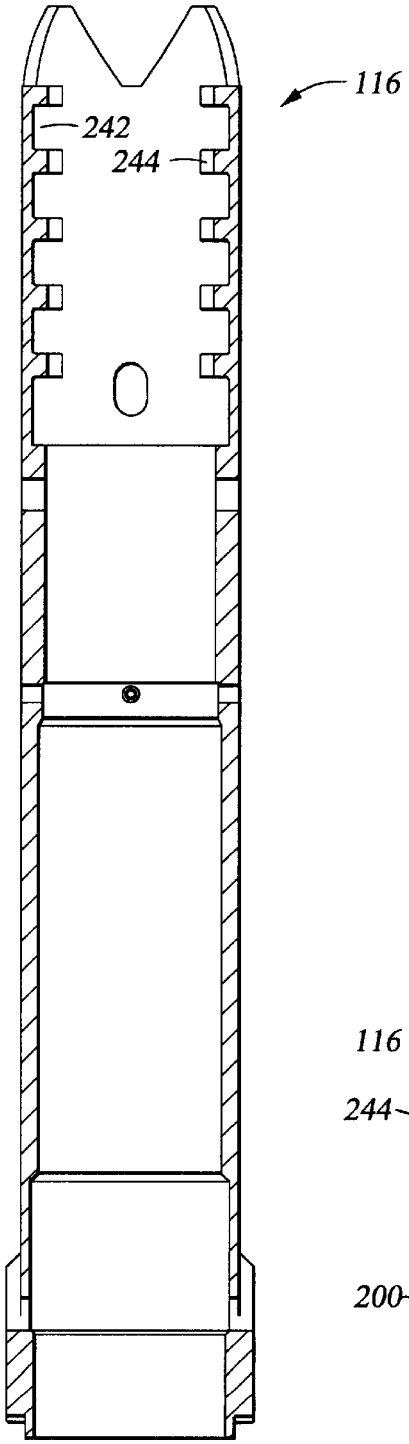
FIG. 11 is cross-sectional view of a torque sleeve.
Figure 12:
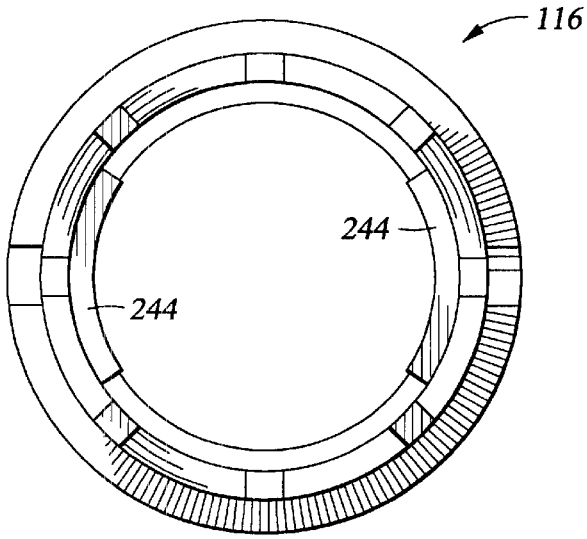
FIG. 12 is a top cross-sectional view of the torque sleeve shown in FIG. 11.

Referring now to FIG. 11 and FIG. 12 a cross sectional view and a top view of the torque sleeve 116 is shown.

Figure 13:
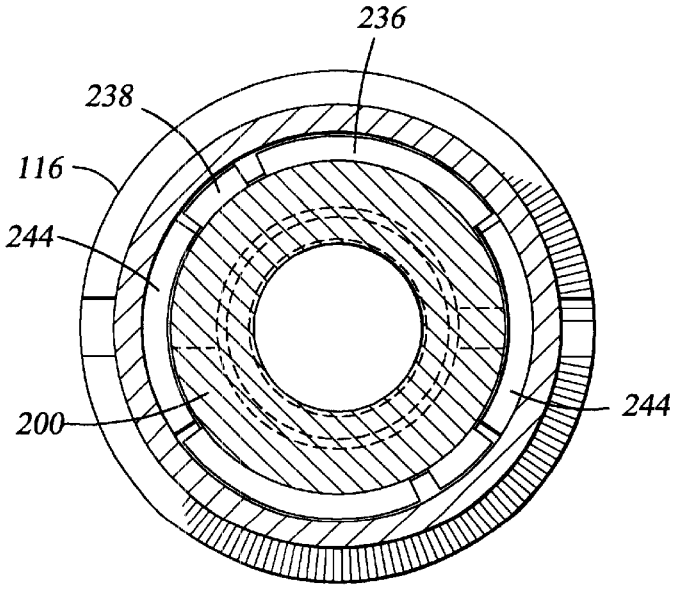
FIG. 13 a top cross-sectional view of the bayonet shown in FIG. 9 disposed in the torque sleeve shown in FIG. 11.

Fingers 244 formed on an inner surface of the torque sleeve 116 define recesses 242 for containing the ribs 236. The fingers 244 are structurally similar to the ribs 236. That is, the fingers 244 comprise two sets of axially equidistant annular sections wherein each set of fingers 244 is disposed on opposite sides of the torque sleeve 116 in facing relationship with the other set. Further, the radial space between each set is dimensioned to accommodate the ribs 236 and the stop member 238 of the bayonet 200. Accordingly, when the ribs 236 and the stop member 238 are rotationally offset from the fingers 236, the bayonet 200 may be inserted into the torque sleeve 116. This position is illustrated in FIG. 13 which shows a top view of the bayonet 200 and the torque sleeve 116. When the bayonet 200 is inserted to a point at which the ribs 236 are aligned with the recesses 242, the bayonet 200 is rotated so that the ribs 236 move into the recesses 242. The bayonet continues rotation until the stop member 238 engages the fingers 244. The bayonet 200 is now in a "locked" position relative to the torque sleeve 116.

Referring back to FIG. 8 (and particularly to FIG. 8C), the bayonet 200 is shown in the "locked" position. Accordingly, the ribs 236 are disposed in the recesses 242 defined by fingers 244 of the torque sleeve 116. As shown, the recesses 242 have a width greater than the ribs 236 to allow some relative axial movement between the bayonet 200 and the torque sleeve 116. Initially, in the assembly position, the upper surfaces 239 of the ribs 236 abut the fingers 244. However, upon attaching a liner hanger, the torque sleeve 116 rides up toward the clutch sleeve 118 while the bayonet 200 remains stationary. Thus, in the compressive running-in position, the lower surfaces 240 of the ribs 236 abut the fingers 244 as shown in FIG. 8C.

As shown in FIG. 8A, the clutch sleeve 118 is concentrically slidably disposed over the lower portion 120 of the top connector 114. The inner surface of the clutch sleeve 118 carries a seal 211 which prevents fluid flow from the chamber 210 and is also adapted to tolerate relative axial movement between the lower portion 120 and the clutch sleeve 118. The stroke of the clutch sleeve 118 is delimited by a shoulder 212 formed on the top connector 114 and that engages an upper surface 214 of the clutch sleeve 118. In a particular embodiment, the farthest distance D1 between the shoulder 212 and the upper surface 214 is about 2 inches. However, more generally, the distance D1 may be any length as determined by a particular application. It should be noted that the slot 122 is also dimensioned to allow the key 124 to travel a distance substantially equal to D1 within the slot 122. Thus, either or both of the slot 122 and the shoulder 212 may act to define the clutch sleeve stroke.

In order to maintain the maximum distance D1 between the shoulder 212 and the upper surface 214, a return coil 220 is provided. The return coil 220 acts to motivate top connector 114 (and hence the bayonet 200) and the clutch sleeve 118 in opposite directions. In a particular embodiment, return coil 220 is disposed in the annular upper chamber 210 defined by the inner diameter of the clutch sleeve 118 and the outer diameter of the bayonet 200. The chamber 210 is sealed at either end by the lower portion 120 of the top connector 114 and a torque-dampening system 260 that also act to compress the return coil 220 at its ends.

The stroke speed of the clutch sleeve 118 relative to the lower portion 120 is controlled by the torque-dampening system 260. The torque-dampening system 260 (also referred to herein as "the system 260") is best described with reference to FIG. 8B. The system 260 generally comprises a sealing bushing 262 containing flow restrictors. The sealing bushing 262 is a generally annular member (in the form of a collar) and is disposed between the inner diameter of the clutch sleeve 118 and the outer diameter of the bayonet 200. The sealing bushing 262 abuts a rim 265 formed on in inner surface of the clutch sleeve 118 which provides a biasing surface to drive the sealing bushing 262 axially upward (toward the top connector 114) during the up-stroke of the clutch sleeve 118. In another embodiment, the sealing bushing 262 may be secured to the hydraulic cylinder 118 by fasteners such as screws. In still another embodiment, the sealing bushing 262 and the clutch sleeve 118 are integral components. For example, the sealing bushing 262 and the clutch sleeve 118 may be formed of a single piece of material. More generally, the sealing bushing 262 is fixedly disposed relative to the clutch sleeve 118 so that the sealing bushing 262 is carried by the clutch sleeve 118 during its up-stroke.

In an initial position (as shown in FIG. 8), the sealing bushing 262 also abuts a split ring 268 secured to the bayonet 200 with a retainer spring 270. The split ring 268 prevents a balance piston 310 (described below) from riding up too far on the bayonet 200. In addition, the split ring 268 restricts the travel of the sealing bushing 262 relative to the bayonet 200.

The sealing bushing 262 provides at least one fluid passageway to allow fluid flow from the upper chamber 210 to a lower chamber 266. In a particular embodiment, one such fluid passageway is defined by an orifice 272 and a cavity 274 in fluid communication with one another. The cavity 274 is defined by sealed at an upper end by a keeper 276 which also defines a portion of a lower buttressing surface to the return coil 220. Fluid flow over and around the sealing bushing 262 is prevented by O-rings 263A–B disposed between the sealing bushing 262 and the clutch sleeve 118 and between the sealing bushing 262 and the bayonet 200, respectively.

In order to control the fluid flow between the chamber 210 and chamber 266 via the orifice 272 and the cavity 274, a flow restictor is housed in the sealing bushing 262. In one embodiment, the flow restrictor comprises a restrictor member disposed in the orifice 272 and adapted to provide impedance to fluid flow from the chamber 210 to the lower chamber 266. Illustratively, the impedance is achieved by a bypass pin 264 having a tortuous fluid flow path 278 formed on its outer surface. The path is narrow, shallow and labyrinthine so that fluid flowing therethrough experiences a substantial pressure drop.

It should be noted that the above-described bypass pin 264 is merely illustrative. More generally, flow impedance may be achieved by any means adapted to slow the flow of fluid between the chambers 210, 266. For example, in another embodiment, the by-pass pin 264 may be a fluid permeable member, such as a porous filter. In yet another embodiment, flow impedance is accomplished by reducing the diameter of the orifice 272, thereby eliminating the need for a bypass pin or other member disposed within the orifice 272. Other embodiments will be readily recognized by those skilled in the art.

As shown in FIG. 8B, the cavity 274 contains a sintered metal filter 280. The filter 280 is biased against a surface of the sealing bushing 262 (and downward toward the bypass pin 264) by a spring 282. The filter 280 acts to prevent contaminants from plugging the bypass pin 264.

The sealing bushing 262 also houses a check valve assembly 290. The check valve assembly 290 includes a blocking member 292 (e.g., a ball) biased downwardly against a seating surface of the sealing bushing 262 by a spring 294. The spring 294 is restrained at its upper end by a retainer 296 that forms an outlet 298. In its initial position, the blocking member 292 blocks an inlet 300 that is fluidly connected at its lower end to the lower chamber 266. This position (i.e., "closed position") is maintained so long as the pressure in the chamber 210 is greater than or equal to the pressure in the lower chamber 266. Once the pressure in the lower chamber 266 increases beyond the pressure in the chamber 210, the blocking member 292 is biased upwardly toward the chamber 210 and disengages from the seating surface of the sealing bushing 262. The check valve assembly 290 is then said to be in a "open position," and fluid is permitted to flow freely from the lower chamber 266 to the upper chamber 210.

In one embodiment, the running tool 100 also includes a balance piston 310 adapted to compensate for fluid expansion and pressures. As can be seen in FIG. 8B, the balance piston 310 is an annular member slidably disposed between the inner diameter of the clutch sleeve 118 and the outer diameter of the bayonet 200. The piston is provided a range of axial movement between the split ring 268 and an annular ledge 311 formed on the bayonet 200. O-rings 312 disposed on the inner and outer surfaces of the balance piston 310 maintain annular seals with respect to the bayonet 200 and the clutch sleeve 118, respectively.

An upper end of the balance piston 310 defines an axial channel 314 that is radially traversed by a bore 316. The bore 316 allows fluid communication between the lower chamber 266 and an interior annular region 315 formed between the bayonet 200 and the balance piston 310. The axial channel 314 terminates at a lower end in a relatively diametrically enlarged volume 317 housing a check valve assembly 320. The check valve assembly 320 generally comprises a grooved check valve member 322, a valve seat 324, a valve retainer 326, and a spring 328. The spring 328 is disposed between the valve retainer 326 and the check valve member 322 and urges the check valve member 322 upwardly toward the valve seat 324. A tip 330 of the check valve member 322 is conformed to be received in a conduit 332 of the valve seat 324, thereby blocking fluid flow through the conduit 332.

During operation of the running tool 100, a pressure gradient between the interior spaces of the tool and the external environment may occur (e.g., due to fluid expansion). For example, the ambient pressure (i.e., the pressure in the well bore) may become greater than the pressure in the lower chamber 266. In response, the balance piston 310 is urged upwards toward the chamber 266. Accordingly, the fluid in the chambers 210, 266 is compressed until the interior and exterior pressure conditions are equalized.

In the event of a pressure gradient increasing from the well bore to the lower chamber 266 (i.e., the pressure is relatively greater in the chamber 266), the balance piston 310 is urged downward toward the ledge 311, thereby relieving the pressure in the chamber 266. If, when the piston 310 engages the ledge 311, a sufficient pressure gradient still exists, the check valve member 322 may be actuated to further relieve the pressure gradient. Specifically, the fluid pressure in the axial channel 314 and the conduit 332 forces the tip 330 out of the conduit 332, against the opposing bias of the spring 328. The fluid then flows over grooves 336 formed on the outer surface of the check valve member 322 and out of the volume 317 via an outlet 338 formed in the valve retainer 326. The fluid may then flow through the annular space between the clutch sleeve 118 and the bayonet 200 and ultimately into an external region (i.e., the well bore) through the gap 136 formed between the teeth 130 or through any other opening formed in the tool 100.

The operation of the running tool 100 will now be described in more detail in a right hand rotation run-in application and a subsequent release procedure. The operation of the torque-dampening system 260 and the check valve assembly 290 is described with reference to FIGS. 14–18. Reference is also made back to FIGS. 2–7 to illustrate the corresponding position of the torsion interface 128.

In operation, the running tool is made up and run into the well bore hole while maintaining right hand rotation on the pipe string. As described above, the tool 100 (or more likely, the liner being carried by the tool 100) will occasionally become lodged against an obstruction, thereby preventing rotation. When the tool 100 is subsequently dislodged, the liner being carried by the tool 100 may over-rotate, thereby simulating a left-hand release operation in which the clutch sleeve 118 and the torque sleeve 116 rotate with respect to one another. In the event of over-rotation, the torque-dampening system 260 and, subsequently, the check valve assembly 290, are engaged.

Figure 14:
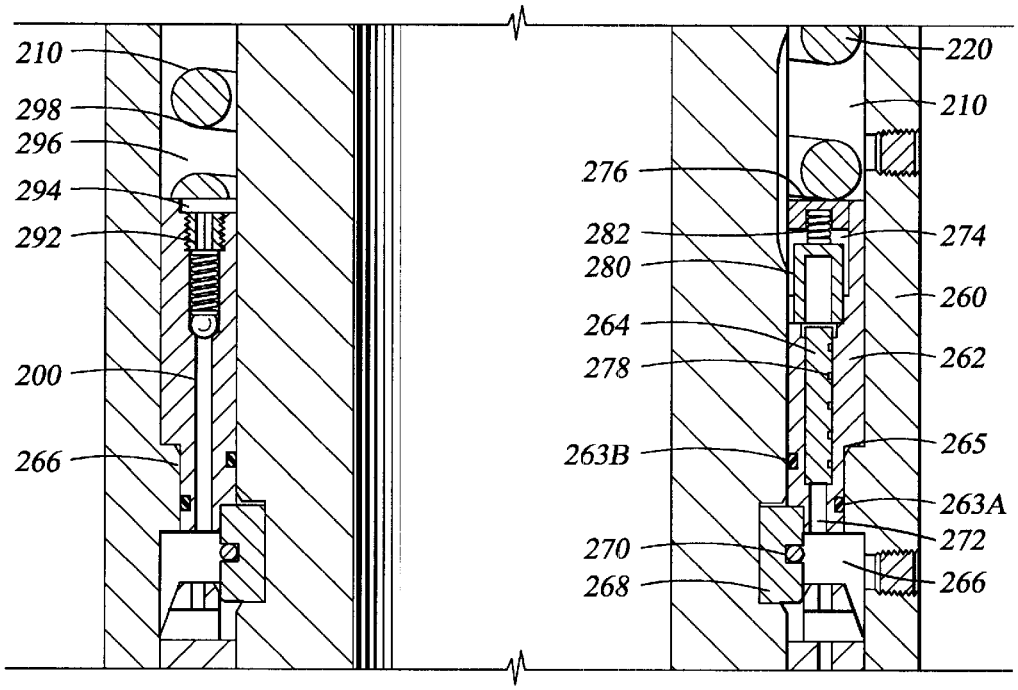
FIGS. 14–17 are a series of cross-sectional drawings of a running tool illustrating the operation of a torque-dampening system.
Figure 15:
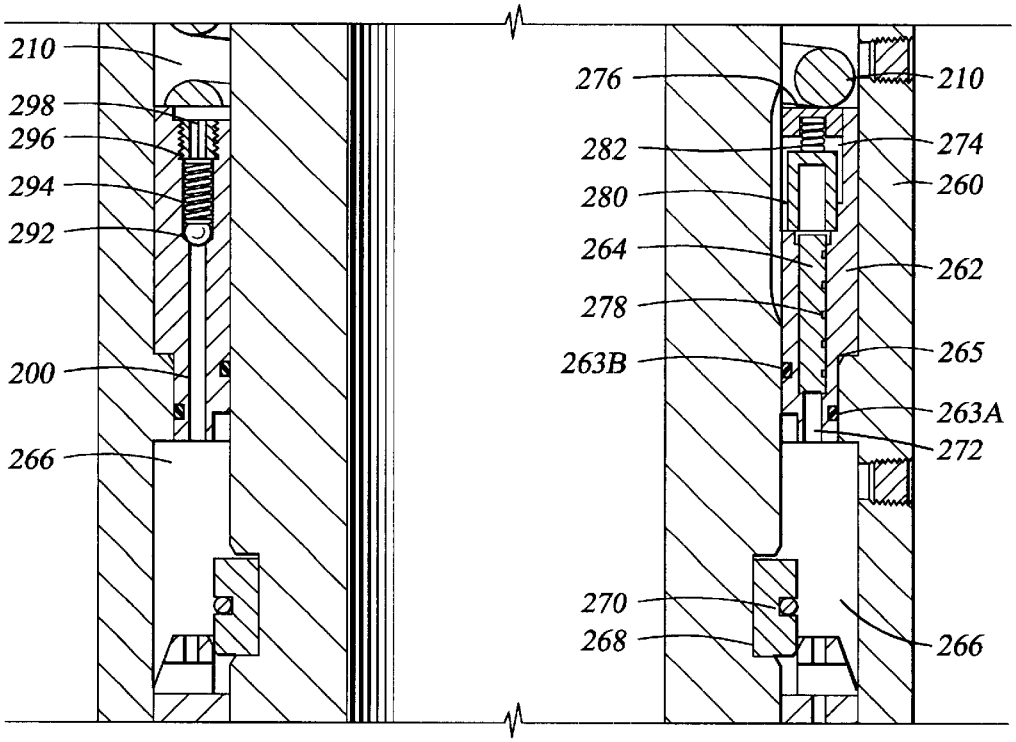

FIG. 14 shows the torque-dampening system 260 in an initial position, i.e., prior to any g relative rotation between the clutch sleeve 118 and the torque sleeve 116. The corresponding position of the torsion interface 128 is shown in FIG. 2. Upon the left-hand rotation of the clutch sleeve 118 relative to the torque sleeve 116, the teeth 130A of the clutch sleeve 118 engage with, and begin to "ride up" on, the teeth 130B of the torque sleeve 116, as shown in FIG. 3. Accordingly, the clutch sleeve 118 strokes up relative to the bayonet 200 and carries the torque-dampening system 260 as shown in FIG. 15. During the up-stroke, fluid from the upper chamber 210 is compressed and is forced through the tortuous path 278 of the bypass pin 264. The resulting impedance provided by the bypass pin 264 works to resist the up-stroke and slows the upward travel of the clutch sleeve 118.

Figure 16:
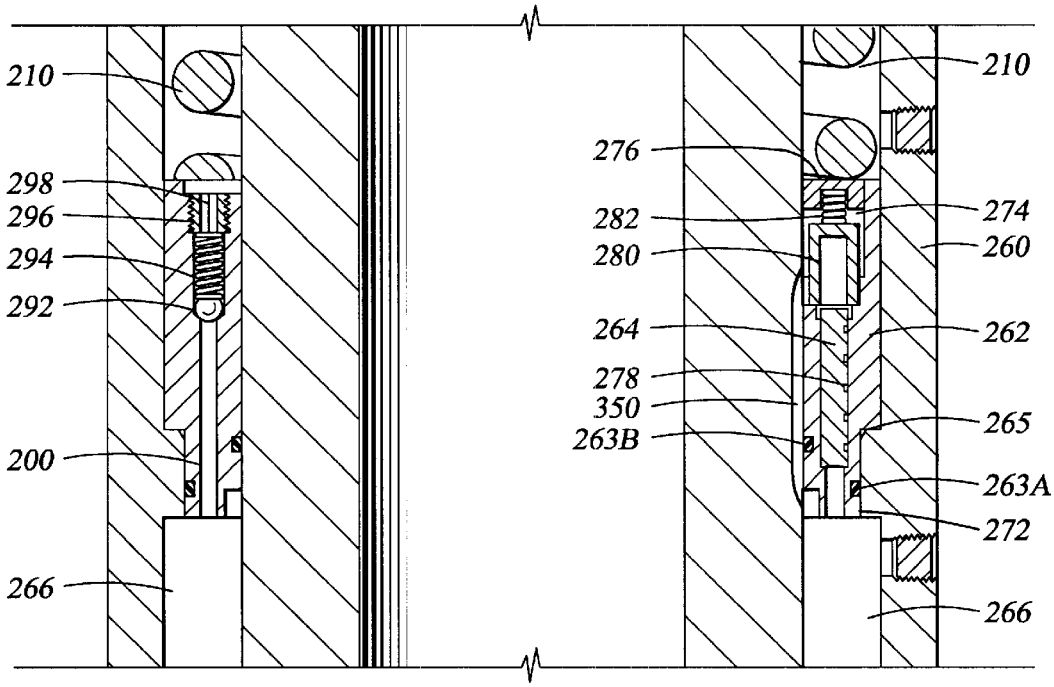

During continued relative rotation of the clutch sleeve 118 and the torque sleeve 116 (shown in FIG. 4), the torque-dampening system 260 clears a plurality of undercuts 350 formed in the outer surface of the bayonet 200, as shown in FIG. 16. At this point, fluid is no longer restricted to traveling through the bypass pin 264 and may instead flow around the sealing bushing 262 via the undercuts 350. Such an embodiment substantially eliminates the dampening provided by the torque-dampening system 260 at a predetermined stage during the up-stroke. This effect may be desirable in order to avoid excessive load being placed on the teeth 130 which may result in their being damaged.

If the left-hand torque ceases before the teeth 130 disengage, the tool 100 will reset to the initial position shown in FIG. 14 and continue its descent into the well bore. If over-rotation is experienced again, the steps above are repeated. In a particular embodiment, the tool may experience left-hand torque of about 1900 ft-lb for a period of time of about 150 seconds before the teeth 130 disengage. However, persons skilled in the art will recognize that the tool 100 can be adapted for other torque and time conditions according to application.

When the running tool and liner hanger have reached the desired depth, the liner may be released from the tool 100. In the case of a hydraulic release, a hydraulic fluid is pumped into the pipe string or tubing string behind a plug, such as a ball. Hydraulic fluid flows from the pipe or tubing string and into the bore 208. As best seen in FIG. 1C, the fluid is flowed through ports 121 disposed at a lower end of the tool 100. With increasing pressure a shear screw 125 securing a hydraulic cylinder 123 is sheared, and the hydraulic cylinder 123 is actuated upwards. The hydraulic cylinder 123 is connected to the collet 115 which is pulled back to release the liner hanger. A locking dog assembly 119 may be actuated to secure the collet 115 in a retracted position.

Figure 17:
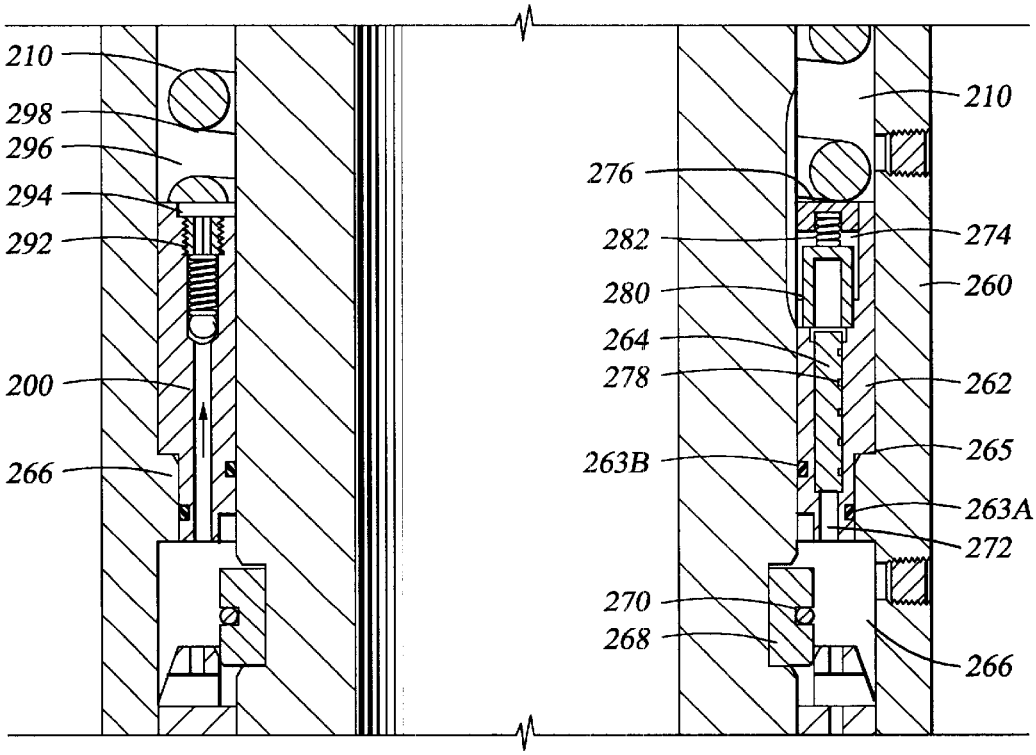
Figure 18:
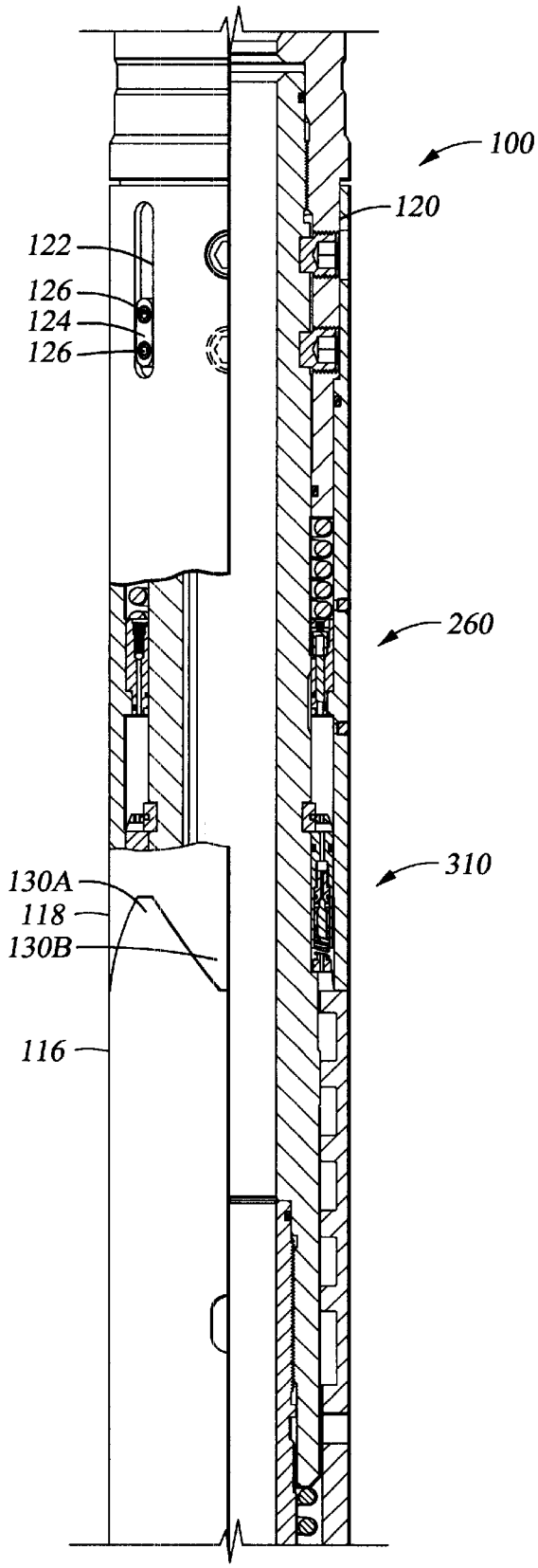
FIG. 18 is a side view partially in section of a running tool in a release position.

However, should the inlets to the source of hydraulic fluid become clogged or should hydraulic fluid otherwise be prevented from operating the releasing mechanisms of the tool 100, a mechanical release procedure is used to advantage. In particular, a left-hand torque is applied to the drill string, and hence, to the top connector 114 and bayonet 200, while the torque sleeve 116 is held stationary by the liner. The left-hand torque effects relative rotation between the torque sleeve 116 and the clutch sleeve 118, thereby actuating the torque-dampening system 260 and, subsequently, the check valve assembly 290 in the manner described above. That is, the torque-dampening system 260 and the check valve assembly 290 respond in the same manner as when the tool experiences over-rotation. However, rather than returning to an initial position (shown in FIG. 14), the continued application of left-hand torque causes the teeth 130 to disengage and rotate past one another as shown in FIG. 5. The clutch sleeve 118 then begins a down-stroke under the bias of the return coil 220 as shown in FIG. 6. In addition, the check valve assembly 290 is opened to allow fluid flow from the lower chamber 266 to the upper chamber 210 as shown in FIG. 17. The running tool 100 then proceeds to the terminal/release position shown in FIGS. 7 and 18. Note that the bayonet 200 has "dropped down" into a release position. Specifically, the ribs 236 have cleared the corresponding fingers 244 and the stop member 238 (not shown) has rotated away from the set of the fingers 244 contacted by the stop member 238 in the initial "locked" position. The stop member 238 now abuts the other set of fingers 244 to prevent further left-hand rotation of the bayonet 200. In this position, a force applied to the top connector 114 moves the bayonet 200 and the mandrel 232 downward into the release position, thereby forcing the bottom connector 112 down relative to the collet 115 which carries the liner. As a result, the liner is disconnected.

In one embodiment, before weight is applied to the running tool 100, the tool 100 may be reset after disengaging from a liner. Specifically, while in tension the bayonet 200 is rotated to the right, thereby reversing the torque-dampening system to the running position.

The foregoing embodiments are merely illustrative and persons skilled in the art will recognize other embodiments. In particular, the invention contemplates numerous embodiments of the torque-dampening system 260. For example, the torque-dampening system may be located in another position in the tool 100, e.g., between the torque sleeve 116 and the mandrel. In some embodiments, the provision of the torque-dampening system between the torque sleeve 116 and the mandrel may eliminate the need for the axially sliding clutch sleeve 118. In another embodiment, the torque-dampening system may be actuated by rotational, rather than linear, movement. In another embodiment, the torque-dampening system may be mechanically actuated rather than fluidly actuated. For example, the torque-dampening system may comprise a coil (spring), such as coil 220, without the use of the sealing bushing 262 and associated flow restrictor assembly. In still another embodiment, the torque-dampening system may comprise elastic members connecting the clutch sleeve 118 and the torque sleeve 116, thereby inhibiting relative axial movement away from one another. These and other embodiments will be apparent to those skilled in the art.

While the foregoing is directed to preferred embodiments of the present invention, other and further embodiments of the invention may be devised without departing from the basic scope thereof. The scope of the invention is determined by the claims which follow.

What is claimed is:

1. A running tool for a well tool, comprising:

(a) a first portion, a second portion and a torsion interface disposed therebetween; and (b) a torque-dampening system contacting the first portion and adapted to inhibit relative rotational movement between the first and second portions during an opposing linear displacement caused by the torsion interface upon relative rotation of the first and second portions.

2. The running tool of claim 1, wherein the well tool is a liner hanger.

3. The running tool of claim 1, wherein the torque-dampening system abuts a biasing surface formed on an inner surface of the first portion, the biasing surface adapted to urge the torque-dampening system in a linear direction during the opposing linear displacement of the first and second portions.

4. The running tool of claim 1, wherein the torque-dampening system is disposed in an annular member concentrically disposed within the first portion.

5. The running tool of claim 1, further comprising a tubular member concentrically disposed within the first and second portions, wherein the tubular member is slidably disposed relative to the first portion.

6. The running tool of claim 5, further comprising a retaining member secured to the tubular member and slidably disposed in the first portion, wherein the retaining member allows relative axial movement between the first portion and the tubular member while restricting relative rotational movement.

7. The running tool of claim 5, wherein the torque-dampening system is slidably disposed relative to the tubular member and fixedly disposed relative the first portion.

8. The running tool of claim 5, wherein the torque-dampening system is disposed in an annular member slidably disposed relative to the tubular member and fixedly disposed relative the first portion.

9. The running tool of claim 1, wherein the torque-dampening system comprises a flow restrictor.

10. The running tool of claim 9, wherein the flow restrictor comprises a restrictor member having a fluid flow path formed on an outer surface.

11. The running tool of claim 9, wherein the flow restrictor comprises a bypass pin having a tortuous fluid flow path formed on an outer surface.

12. The running tool of claim 9, wherein the flow restrictor is disposed between a first chamber and a second chamber formed between the first portion and a tubular member slidably concentrically disposed within the first portion, and wherein the flow restrictor allows fluid communication between the first and second chambers.

13. The running tool of claim 12, further comprising a balance piston disposed between the first portion and the tubular member, wherein the balance piston comprises a check valve assembly that responds to reduce pressure gradients between the second chamber and ambient conditions.

14. The running tool of claim 12, further comprising a return coil disposed in the first chamber and engaging the torque-dampening system.

15. The running tool of claim 12, wherein the torque-dampening system is disposed in an annular member slidably disposed about the tubular member and positioned to separate the first and second chambers.

16. The running tool of claim 15, further comprising a check valve assembly disposed in the annular member, wherein the check valve assembly is adapted to allow fluid flow only from the second chamber to the first chamber.

17. The running tool of claim 1, further comprising a liner release assembly disposed at a lower end of the second portion and selectively actuated when the torsion interface is rotated into a mechanical release position.

18. The running tool of claim 17, further comprising:

a bayonet concentrically disposed within the first portion and the second portion;

a first set of locking members disposed on an outer surface of the bayonet;

a second set of locking members disposed on an inner surface of the second portion, wherein the first set and second set of locking members are selectively engaged to prevent relative sliding movement between the bayonet and the second portion and are selectively disengaged when the portion interface is rotated into the mechanical release position to allow relative sliding movement between the bayonet and the second portion.

19. A running tool, comprising:

(a) a first sleeve and a second sleeve forming a torsion interface therebetween, wherein the torsion interface is adapted to cause opposing linear displacement of the first and second sleeves upon relative rotation of the first and second sleeves;

(b) a tubular member concentrically disposed within the first and second sleeves, and wherein the tubular member is slidably disposed relative to the first sleeve; and (c) a torque-dampening system disposed between the tubular member and the first sleeve and actuated in response to the opposing linear displacement; the torque-dampening system comprising;

(i) an annular member slidably disposed about the tubular member and contacting the first sleeve, wherein the annular member is positioned to separate a first chamber and a second chamber; and (ii) a flow restrictor disposed in the annular member and adapted to allow fluid communication between the first and second chambers.

20. The running tool of claim 19, further comprising a valve assembly adapted to allow flow only from the second chamber to the first chamber.

21. The running tool of claim 19, wherein the annular member abuts a biasing surface formed on an inner surface of the first sleeve, the biasing surface adapted to urge the torque-dampening system in a linear direction during the opposing linear displacement of the first and second sleeves.

22. The running tool of claim 19, further comprising a return biasing member disposed in a space between the first sleeve and the tubular member.

23. The running tool of claim 19, wherein the return biasing member comprises a coil annularly disposed about the tubular member.

24. The running tool of claim 19, wherein the flow restrictor comprises a restrictor member having a fluid flow path formed on an outer surface to allow fluid communication between the first and second chambers.

25. The running tool of claim 19, wherein the flow restrictor comprises a bypass pin having a tortuous fluid flow path formed on an outer surface to allow fluid communication between the first and second chambers.

26. The running tool of claim 25, further comprising a balance piston disposed between the first sleeve and the tubular member, wherein the balance piston comprises a check valve assembly that responds to reduce pressure gradients between the second chamber and ambient conditions.

27. The running tool of claim 25, further comprising a return coil disposed in the first chamber and engaging the torque-dampening system.

28. A running tool comprising:

(a) a first sleeve defining a first plurality of teeth at one end of the first sleeve;

(b) a second sleeve defining a second plurality of teeth at one end of the second sleeve, wherein the first plurality of teeth and the second plurality of teeth are intermeshed and cause an opposing linear displacement of the first sleeve and second sleeve upon relative rotation between the sleeves;

(c) a tubular member comprising a bottom connector and a top connector, at least partly disposed within the first and second sleeves; and wherein at least a portion of the tubular member is slidably disposed relative to the first sleeve; and (d) a torque-dampening system disposed between the tubular member and the first portion and actuated in response to the opposing linear displacement; the dampening system comprising:

(i) an annular member slidably disposed relative to the tubular member and carried by the first portion in at least a first direction away from the second sleeve during the opposing linear displacement;

(ii) a flow restrictor disposed in the annular member and adapted to allow fluid communication between a first chamber and a second chamber formed between the tubular member and the first sleeve and separated by the annular member;

(iii) a first valve assembly adapted to allow flow only from the second chamber to the first chamber; and (iv) a balance piston disposed between the first sleeve and the tubular member, wherein the balance piston comprises a second valve assembly that responds to reduce pressure gradients between the second chamber and ambient conditions; and (e) a return biasing member disposed in the first chamber and abutting the torque-dampening system at one end and abutting the top connector at a second end.

29. The running tool of claim 28, wherein the tubular member comprises a bayonet and a mandrel.

30. The running tool of claim 28, wherein the tubular member comprises a ribbed portion formed on an outer surface and adapted to be rotated into a mating ribbed portion formed on an inner surface of the second sleeve.

31. The running tool of claim 28, wherein the flow restrictor comprises a restrictor member having a fluid flow path formed on an outer surface.

32. The running tool of claim 28, wherein the flow restrictor comprises a restrictor member having a tortuous fluid flow path formed on an outer surface to allow fluid communication between the first and second chambers.

33. The running tool of claim 28, further comprising a retaining member secured to the tubular member and slidably disposed in the first sleeve, wherein the retaining member allows relative axial movement between the first sleeve and the tubular member while restricting relative rotational movement.

34. The running tool of claim 28, wherein the return biasing member is a coil.

35. A liner hanger running tool, comprising:

(a) a tubular member, (b) a top connecting member disposed at one end of the tubular member and adapted to be connected to a tubular string;

(c) a bottom connecting member disposed at another end of the tubular member and adapted to be received by a liner hanger;

(d) a sleeve disposed about the tubular member and comprising at least a portion rotatably disposed relative to the tubular member, (e) a torque-dampening system disposed between the tubular member and the sleeve, wherein the torque-dampening system restricts relative rotation between the at least the portion and the tubular member.

36. The running tool of claim 35, wherein the tubular member is axially slidably disposed relative to another portion of the sleeve.

37. The running tool of claim 35, wherein the sleeve comprises castellations formed at a lower end thereof.

38. The running tool of claim 35, wherein the tubular member comprises a mandrel and a bayonet each carrying a plurality of ribs intermeshed with one another.

39. The running tool of claim 35, wherein the torque-dampening system comprises a flow restrictor.

40. The running tool of claim 35, wherein the sleeve comprises a first portion and a second portion defining a torsion interface adapted to cause an opposing linear displacement of the first and second portions upon relative rotation of the first and second portions.

41. The running tool of claim 40, wherein the torque-dampening system abuts a biasing surface formed on an inner surface of the first portion, the biasing surface adapted to urge the torque-dampening system in a linear direction during the opposing linear displacement of the first portion and the second portion.

42. The running tool of claim 40, further comprising a retaining member secured to the tubular member and slidably disposed in the first portion, wherein the retaining member allows relative axial movement between the first portion and the tubular member while restricting relative rotational movement therebetween.

43. The running tool of claim 40, wherein the torque-dampening system is slidably disposed relative to the tubular member and fixedly disposed relative the first portion.

44. The running tool of claim 40, wherein the torque-dampening system comprises a flow restrictor disposed between a first chamber and a second chamber formed between the first portion and the tubular member, and wherein the flow restrictor allows fluid communication between the first and second chambers.

45. A method for dampening rotation of a first portion relative to a second portion on a running tool, wherein the first portion is adapted to interface with a down hole tool, the method comprising:

rotating the first portion relative to the second portion; and restricting the rotation of the first portion relative to the second portion by actuating a fluid-actuated torque-dampening system operably connected to the first portion.

46. The method of claim 45, wherein the rotation of the first portion is restricted for less than a full rotation relative to the second portion.

47. The method of claim 45, terminating the rotation of the first portion at a mechanical release position in which the first portion can be released from the down hole tool.

48. The method of claim 45, wherein the fluid-actuated torque-dampening system comprises a flow restrictor disposed between a first chamber and a second chamber formed between the first portion and a tubular member, and wherein restricting the rotation of the first portion comprises flowing fluid from the first chamber to the second chamber.

49. The method of claim 45, further comprising:

axially actuating the second portion relative to the first portion in response to rotating the first portion, wherein the first and second portions are operably connected at a torsion interface adapted to translate relative rotation between the first and second portions into axial movement of the second portion relative to the first portion; and restricting axial movement of the second portion.

50. The method of claim 49, wherein restricting axial movement of the second portion comprises actuating the fluid-actuated torque-dampening system.

51. The method of claim 50, wherein actuating the torque-dampening system comprises flowing a fluid therethrough.

52. The method of claim 50, wherein the fluid-actuated torque-dampening system is connected to the second portion.

53. The method of claim 45, further comprising rotating the first portion relative to the second portion to place the running tool in a liner release position.

* * * * *